US005257743A

United States Patent [19]

Brown, Jr.

[11] Patent Number: 5,257,743

[45] Date of Patent: Nov. 2, 1993

[54] QUARRY PULVERIZER

[76] Inventor: Charles K. Brown, Jr., 8317 Robert Bruce Dr., Richmond, Va. 23235

[21] Appl. No.: 838,651

[22] Filed: Feb. 20, 1992

[51] Int. Cl.[5] ..... B02C 7/00

[52] U.S. Cl. ..... 241/257.1; 241/249

[58] Field of Search ..... 241/146, 220, 244, 248, 241/253, 257.1, 258, 259

[56] References Cited

U.S. PATENT DOCUMENTS 4,834,300 5/1989 Wojciechowski et al. ..... 241/257.1

*Primary Examiner*—Douglas D. Watts

*Attorney, Agent, or Firm*—Walter G. Finch

[57] ABSTRACT

A quarry pulverizer for use as a reduction process machine for rocks and mineral bearing ores is provided for use. The purpose of the quarry pulverizer is to enhance the ability to meet product grading requirements without adding cost or time to the operation, to reduce maintenance costs associated with these types of machines, to increase feeding capacity, to demonstrate how a centrifugal reduction machine can eliminate wear to its central rotor, and to present a pulverizer with an overall modular design that can be tailored to meet a customer's needs. The invention also introduces the concept of how a static impact area may be changed into a dynamic impact area and subsequently increase reduction efficiency. A quarry pulverizer is provided to act as a reduction process machine for rocks or mineral bearing ores. It consists of a top cover with a collecting hopper to accept material feed stock, together with a vertically mounted cup-shaped rotor that receives the material feed stock from the top cover and centrifugally accelerates the material upwardly and over its rim. A modular system of shelves surrounds the rim of the rotor cup that bank up with the material or inlaid with metal/blocks and act as an impacting area for the oncoming of material, chutes where the material may gravity discharge. A motor turns the rotor cup by means of a shaft running vertically along the longitudinal axis of the pulverizer.

14 Claims, 13 Drawing Sheets

QUARRY PULVERIZER

BACKGROUND OF THE INVENTION

This invention relates to rock and mineral bearing ore reduction machines, and more particularly, to a rotary cup attrition mill to be used for product grading in the post mining industry.

PRIOR ART

The best known prior U.S. art is as follows:

| | |
|---|---|
| 323,147 | 2,977,055 |
| 1,041,495 | 3,096,037 |
| 1,770,442 | 3,146,959 |
| 1,811,438 | 3,934,826 |
| 2,109,856 | 3,946,950 |
| 2,189,441 | 4,046,325 |
| 2,525,781 | 4,049,202 |
| 2,557,865 | 4,340,616 |
| 2,609,995 | 4,366,929 |
| 2,651,471 | |

Machines which reduce rock and mineral bearing ores in size from relatively large chunks coming from a primary crusher to much smaller and finer pieces are well known in the art. Conventional crushers operate on the principle of squeezing the rock between heavy metallic members, such as oscillating cones or jaws. These are known as cone crushers and jaw crushers, respectively. Another machine known as the hammer mill accomplishes material reduction through the pounding of swinging hammers. While these machines are somewhat effective, direct wear on crushing parts is extremely heavy, and feed size is almost always limited.

The Emmanouilidis U.S. Pat. No. 2,557,865 teaches a technique where a plurality of concentric foraminous screens surround a conventional hammer mill and sort out the end product. In U.S. Pat. No. 1,770,442, Cott introduces an impact hammer that can be rotated to reveal a fresh surface, thus increasing life. In the U.S. Pat. No. 3,146,959, Putnam teaches a technique where material is hammered, and then rebounds back into the hammer a second time for further reduction.

The Schmidt U.S. Pat. No. 4,049,202 illustrates a method whereby, as material wears on a hammer, an equalization mass balances the hammer into correct angular position, thus prolonging life. In the U.S. Pat. No. 4,046,325, a machine with a primary rotor impactor and a secondary hammer mill which can work in both the wet and dry mode is introduced. The "Coalpactor" is the subject of Fawcett U.S. Pat. No. 2,977,055, wherein a machine that can produce various degrees of pulverization and is capable of reducing, with one pass, coal to a size where 80% of the finished product will fit in a ⅛" or less screen opening.

In U.S. Pat. No. 2,109,856, Beaudry teaches improvements to the horizontally rotating crushing mill where the new invention incorporates hollow intake and outlet trunnions. The Ligget, et al U.S. Pat. No. 1,041,495 discusses improvements to the durability of a swinging hammer mechanism, while the Hilton U.S. Pat. No. 323,147 introduces a concept for pulverizing ores which involves grinders sliding on arms. In U.S. Pat. No. 1,811,438, Riley, et al teaches a method to reduce the danger of breaking impacting parts, thus prolonging life.

Another class of crushers operates on the principal of centrifugal force. The Dear, et al U.S. Pat. No. 3,096,037 teaches of a centrifugally operated crusher which boasts better capacity, better efficiency, and longer life. In the U.S. Pat. No. 2,651,471, Noll provides a machine that incorporates changeable linings which are hard and abrasive and serve to help grind the material as they get hit.

The Klagsbrunn U.S. Pat. No. 2,609,995 teaches of a centrifugally operated mill that reduces wear by performing the grinding action with movable impact members working in conjunction with a stationary member. In the U.S. Pat. No. 2,189,441, Bell shows how a centrifugal force can be used to evenly and effectively crush a thin and even flow of material.

Many of today's centrifugal type machines operate with the concept that material is fed into the center of a high speed rotor with vanes that propel the stone outward at high velocities. The material impacts with great force on material banked walls or on anvils, thus causing size reduction by shock. The Spokane Model 120 crusher employs this concept exactly. It features symmetrical feed tubes and impellers which thrust material feed at high velocities into dovetail mounted anvils. The Barmac Duopactor attempts a rock on rock reduction process by means of excess material cascading down over the feed stock and into high speed rock impelled from the rotor.

Other ideas have also been employed in crushing machines. The Graf U.S. Pat. No. 3,946,950 dismisses crushed material down a confined path leading to a conveyor or screen. In the U.S. Pat. No. 3,934,826, Graveman teaches of a crusher with small holes in its breaker plate where coal small enough to not need to be crushed may escape, thus increasing capacity, reducing fines, and conserving power.

A big problem with any rotating machine is how to deal with the destructive vibrations which occur when the "load" is out of balance. In the U.S. Pat. No. 2,525,781, DeRemer uses high density liquid filled rings to absorb vibration.

The seemingly best way to reduce the size of a mineral bearing ore or stone seems to be to have the material collide with itself, thus preserving metal parts. In the U.S. Pat. No. 4,366,929, Santos introduces a machine where material is made to rapidly change direction and collide with each other. The Weinert U.S. Pat. No. 4,340,616 explains the importance of coating a metallic surface which is to be bombarded with material with a layer of material. In this invention, walls with a magnetic attraction hold a sufficient layer of protective particles.

OBJECTS OF THE INVENTION

It is an object of this invention to provide a quarry pulverizer to be used for reduction of rock and mineral bearing ores.

Another object of this invention is to provide a very effective form of material reduction while eliminating the disadvantages of the previously mentioned concepts.

Still other objects of this invention are to provide a novel quarry pulverizer which is effective and efficient in operational use, which reduces maintenance costs, and which by its modular construction and variable speed drive adds versatility to the operation.

To provide a quarry pulverizer which employs a pattern feeding of material to the rotor using a variety of feed plates, thus resulting in an early crushing action, no reasonable feed size restrictions, a dynamically moving bed of material, a reduction in upstream crushing, and better finished product grading are other objects of this invention.

To provide a quarry pulverizer which is useful in the reduction process of stones and ores which uses an impellerless open top rotor cup capable of holding a set of cone defining spaced rings to define a conical cavity within the cup thus maintaining rotor cup symmetry, employs a top wear ring for wear protection, or alternatively uses a castellated top wear ring for wear protection as well as better impacting, fixes a static shell around its outer perimeter for wear protection, sits on a self balancing housing with spherically mating parts are still other objects of this invention.

Another object of this invention is to provide a rock reducing machine which uses a modular static impact area that can employ, as an impact surface, material banked shelves or metal impact blocks that do not require individual mounting and can be interchanged with other with other blocks as wear so indicates, are further objects of this invention.

An additional object of this invention is to provide an internal modular recirculator impact zone located concentrically and above the static impact area that is concentric with and outside of the rotor. Some of the material hitting around the circumference of the rotor will be ejected on low energy high flying trajectory that will hit on the internal recirculating impactor and be rebounded back into the rotor cup for further impacting in the rotor and high energy ejection below the recirculating impactor and out to the regular impact zone at a higher velocity for more effective smashing action against the basic impact receiving module.

To provide a mineral bearing ore and stone reduction process machine that can use, as its impact area, a dynamic impact wall that spins counter rotational relative to the lower rotor, wherein the opposing velocities add to the efficiency of the reduction and whereby the dynamic impact wall has anti-vibration safe guards and is self balanced by means of its trunnion support is another object of this invention.

And to provide a quarry pulverizer which permits economical construction with an overall simple design which minimizes costs and maximizes performance, simplifies maintenance by offering an essentially modular design, and reduces maintenance costs by incorporating material impacting on material reduction processes in the rotor and on the impacting modules as well as by protecting vulnerable parts of the apparatus from ricochetting materials with edge protectors, static shields, and wear rings in the rotor are yet other objects of this invention.

BRIEF DESCRIPTION OF THE DRAWINGS

These and other objects and attendant advantages of this invention will become more obvious and apparent from the following detailed specification and accompanying drawings in which.

DESCRIPTION OF THE PREFERRED EMBODIMENTS

Referring now to FIGS. 1 to 19 of the drawings, there is shown two preferred embodiment models of a quarry pulverizer 4, ready to facilitate reduction of the rock or mineral bearing ore material M. One model 4 is a single rotor device and the second model 34 is a dual rotor machine.

Figure 1:
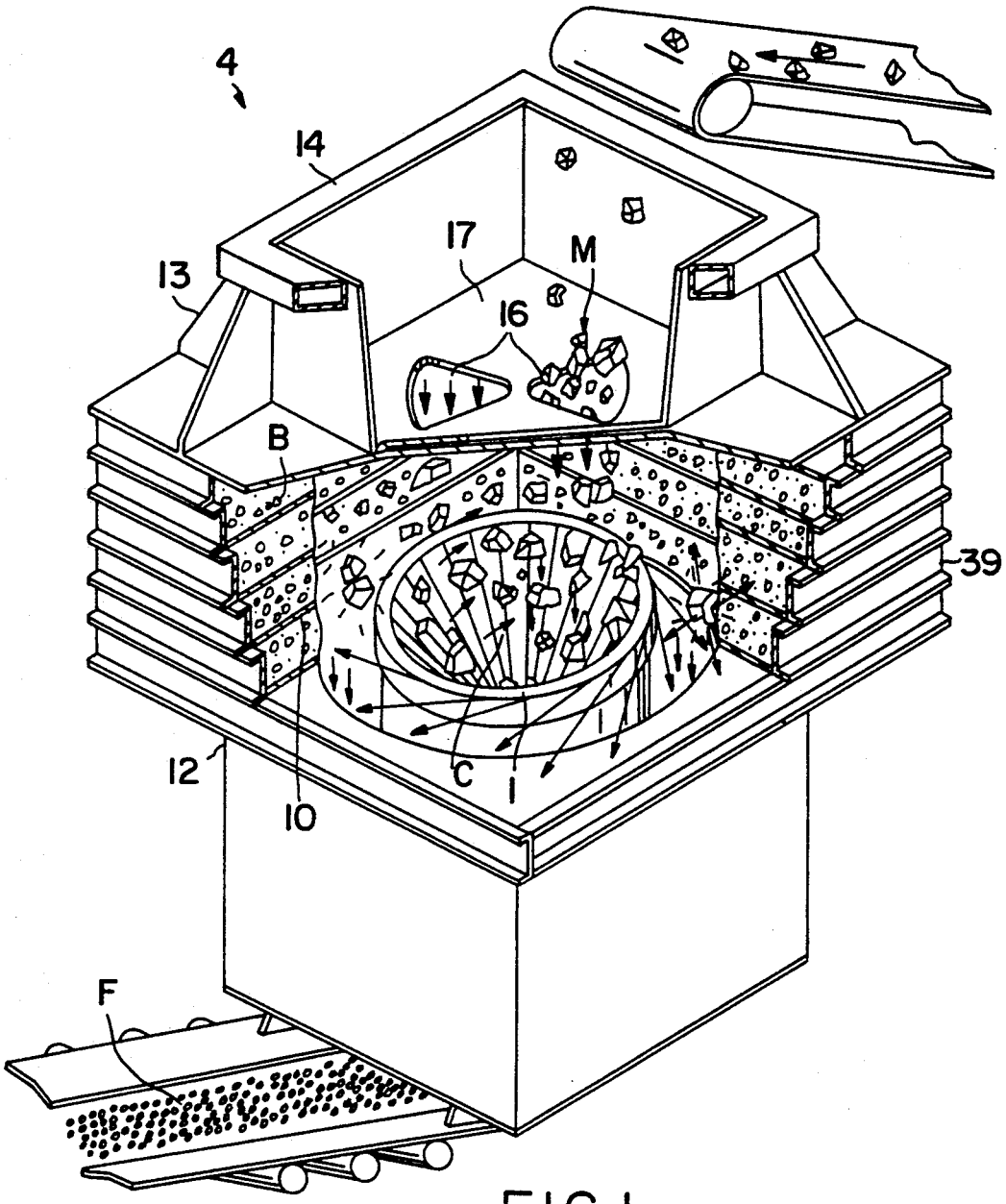
FIG. 1 is a general perspective view of a quarry pulverizer incorporating novel features of this invention.
Figure 2:
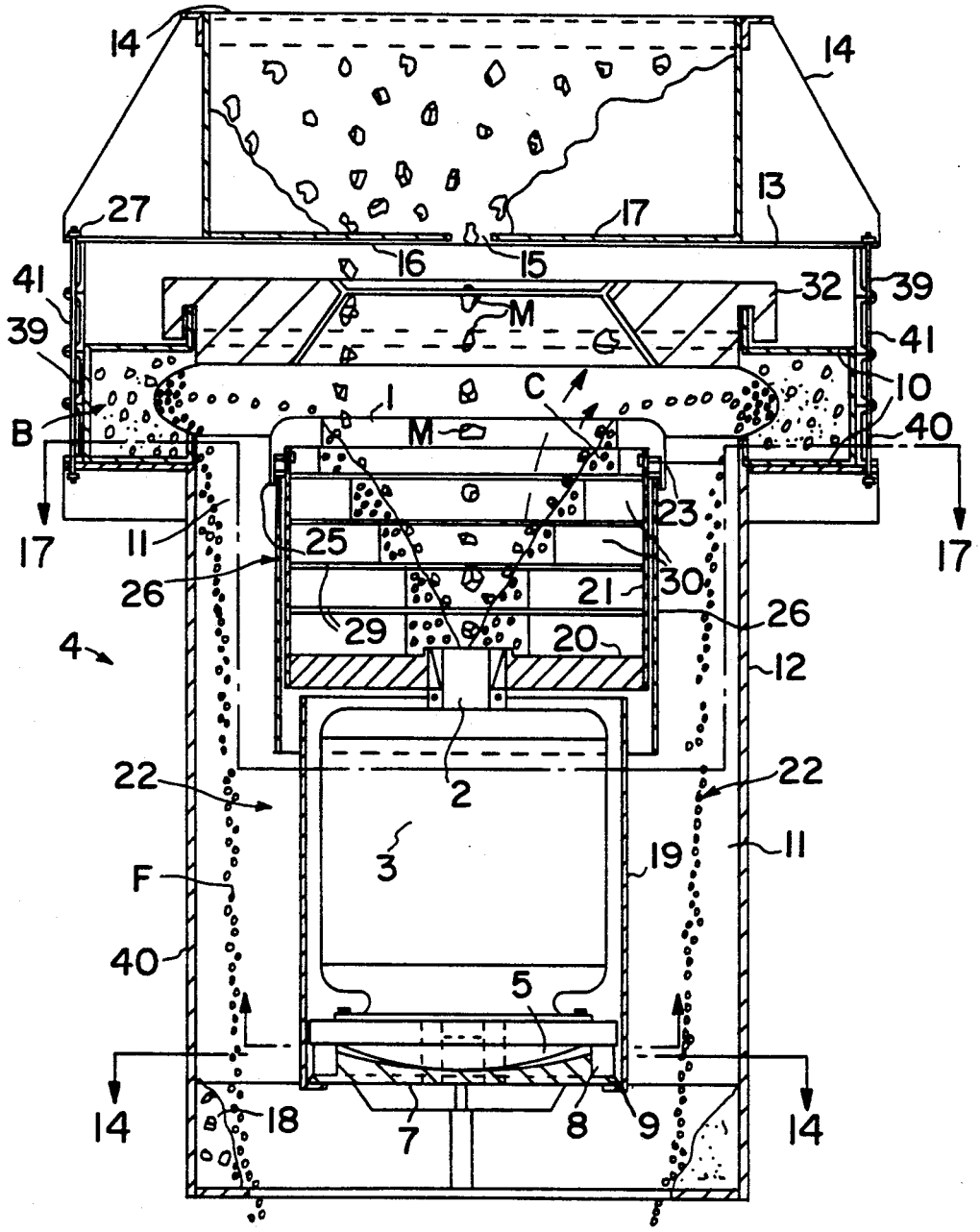
FIG. 2 is a front view of the interior of the quarry pulverizer of FIG. 1, incorporating material on material shelving impact modules area.

FIG. 1 shows a perspective view of the single rotary quarry pulverizer 4 with a corner section removed to reveal the inner construction and actions. Referring now to FIG. 2, material M is dumped into the collecting hopper on top cover 13 and then pattern fed through off-center openings 16 as well as a center opening 15 of a pattern plate 17.

Figure 16:
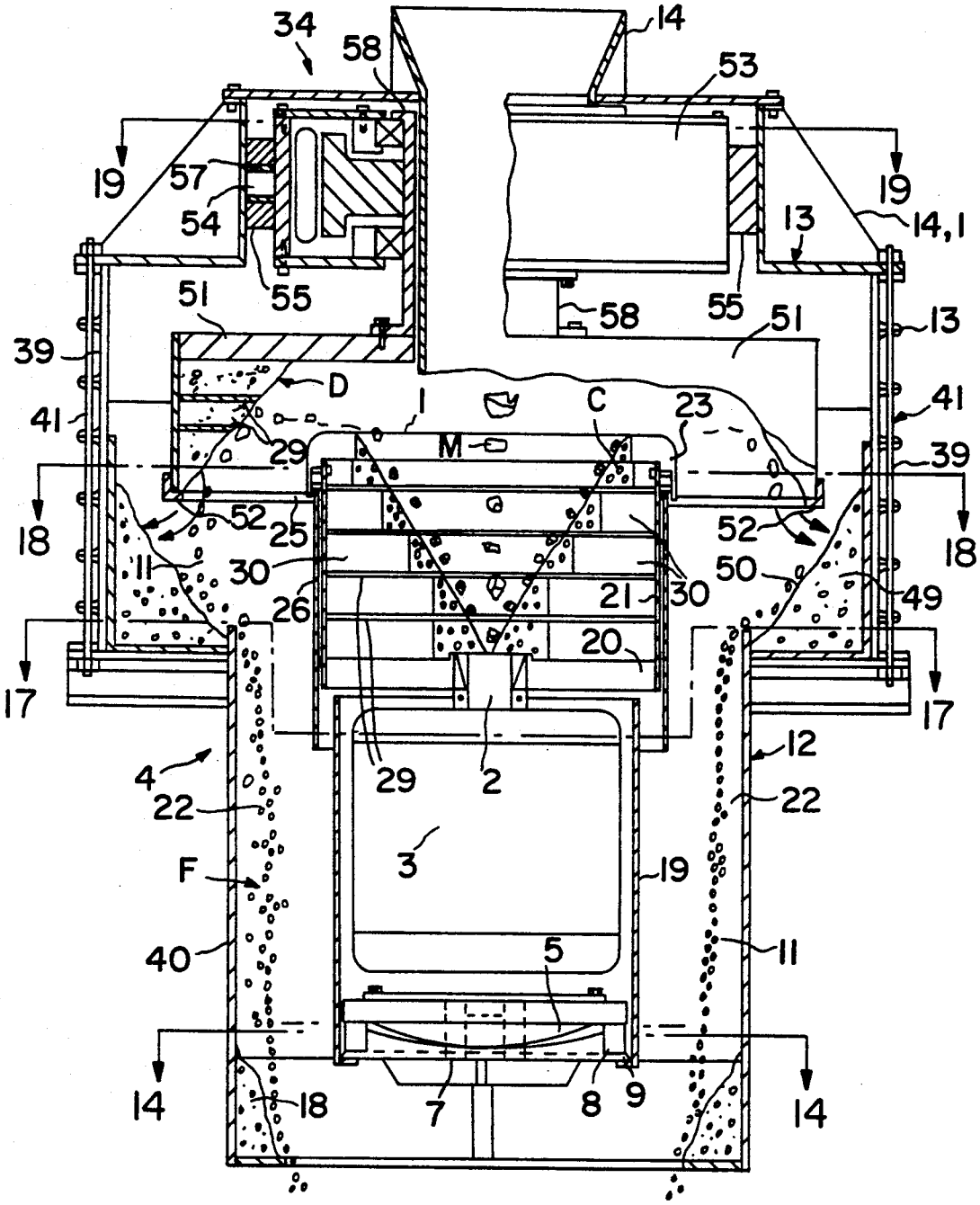
FIG. 16 is a sectional elevation view of the dynamic rotating system of the quarry pulverizer of FIG. 2 with an added upper rotor mounted on a hollow feed shaft.
Figure 17:
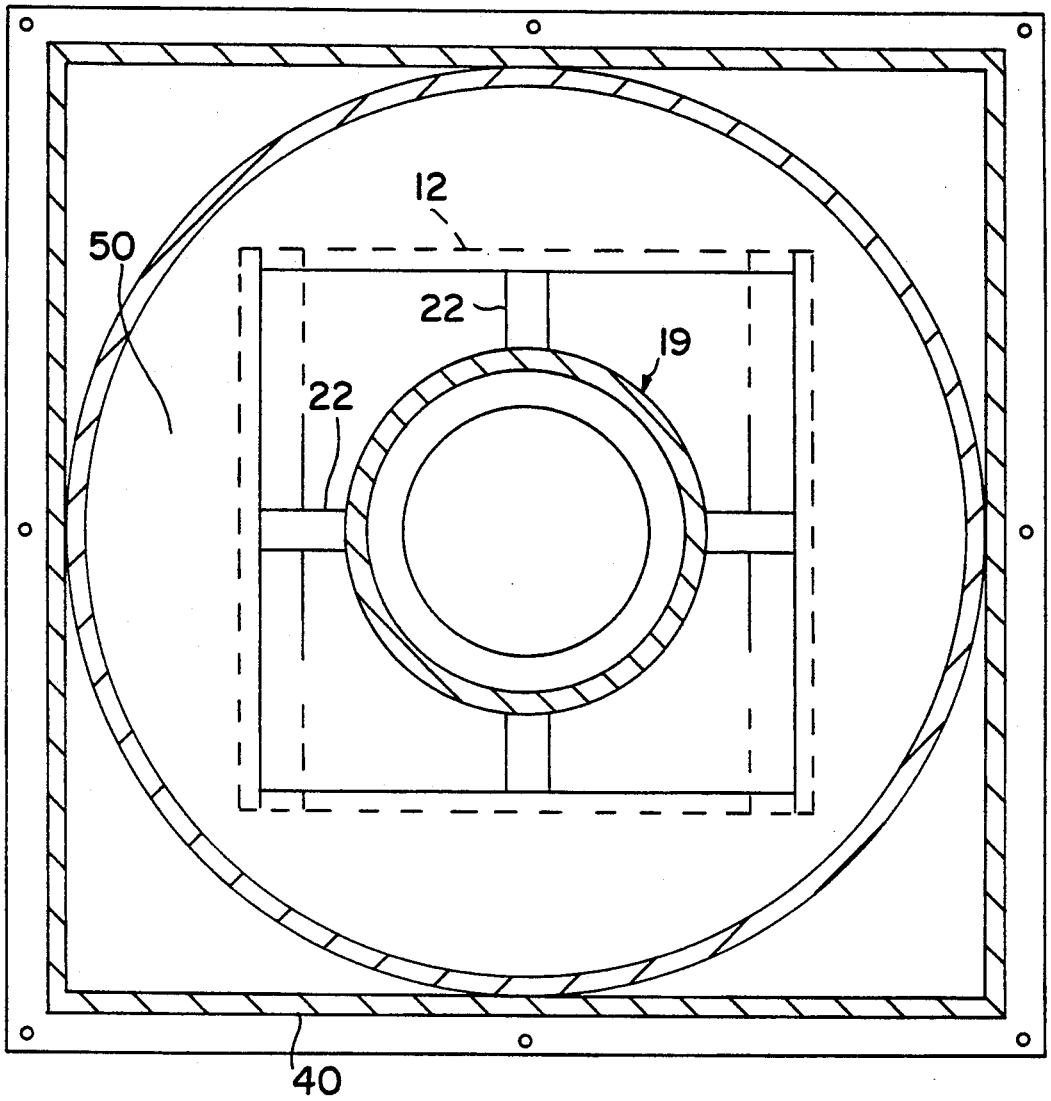
FIG. 17 is a sectional view taken along line B—B of FIG. 2 and FIG. 16 of the quarry pulverizer structure with the motor not shown.

The material falls into the cup of rotor 1 which is spun by means of a shaft 2 connected to a motor 3. Centrifugal acceleration causes the material M to build an embedded cone of material C over top of the inserted rotor cone defining rings 29 spaced apart with spacer blocks 30 as shown in FIGS. 2 and 16. Material M falling into the rotor 1 impacts with material riding the inner surface of the embedded cone of material C, and the first size reduction occurs.

As the rotor 1 spins, subsequent centrifugal acceleration causes the material M to skid up the cone of material C. This is a very abrasive action and may be noted as the second occurrence of size reduction. Finally, material M is flung at high velocity over the rotor wear ring 23 and impacted against an area of banked up material B resting on shelves or ledges 10, thus accomplishing a third reduction action.

Some material M may be initially deflected off the edge protectors 31 sitting on the edges of the shelves 10, but eventually will return to the flow of material M. The shattering action of material M impacting against the banked up material B is a fourth reduction followed by a fifth abrasive action as it skids along the angular faces there present. The sixth and final reduction action of the material M occurs when the material M having reached the impact area is hit from behind with oncoming material M. However, a parallel action will occur that will induce additional reduction actions when some material is bounced or thrown out of the rotor with low centrifugal energy. It is likely also to be flying along high angle trajectories. Material with low kinetic energy breaks up less on impact, therefore, it is desirable to return such material to the rotor for subsequent reacceleration. The recirculating device 31 is angled and located so as to rebound low energy, high thrown material into the cup of the rotor for additional internal reduction.

Figure 3:
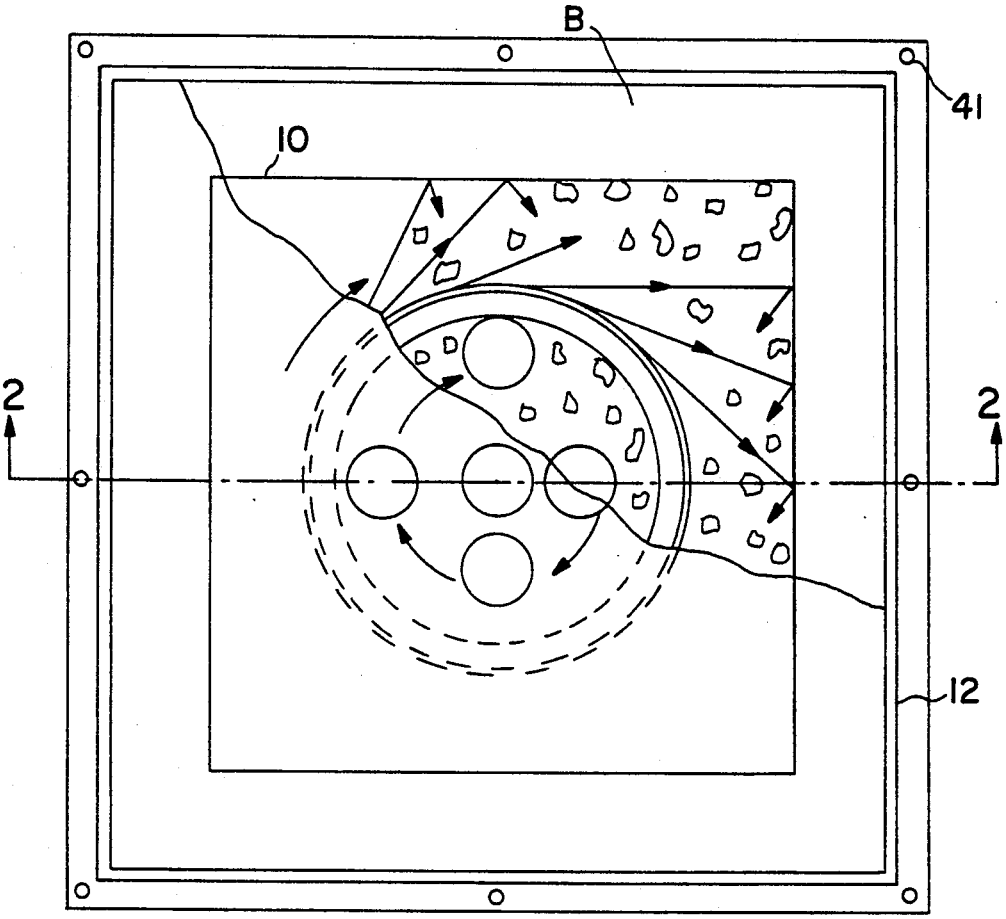
FIG. 3 is a top view of the quarry pulverizer of FIG. 1 showing the thrusting of material onto the secondary impact zone of the impact area module.

The finished product F is then gravity discharged down chutes 11 defined by the general frame support 12 of the quarry pulverizer 4 and a combination of a static shell 26 and a motor housing wall 19. The finished product F is guided into some form of collecting bin or conveyor by means of a lower slide of banked material 18. FIG. 3 shows a top view of the process.

In this system, different feed patterns may be achieved by using different feed plates 17. The idea of pattern feeding, or feeding material M not just through the center of the plate 17, accomplishes a variety of objectives. It enables regulation of feed volume, it allows for more precise product grading, it establishes an early crushing action and it helps create a dynamic balance within the rotor 1.

Figure 4:
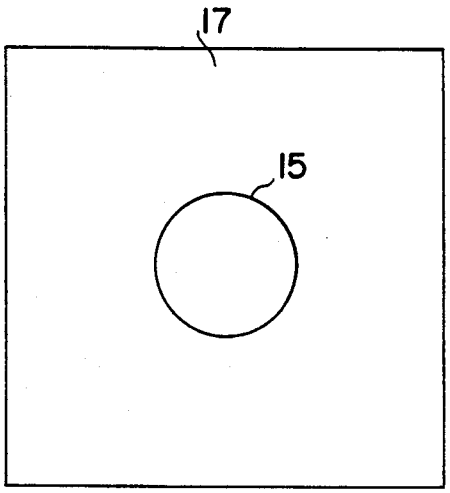
FIG. 4 is a top view of a feed plate of the quarry pulverizer of FIG. 1 with one central opening.

The dynamic balance is achieved by feeding material M through a pattern plate 17 with a center feed opening 15, such as that shown in FIG. 4. The centrifugal acceleration will create an embedded cone of material C within the rotor. The flow of material feeding through the off center openings to the dynamic cone of material C has the ability to cut ridges and fill gaps, that may form, where necessary as more material M flows down into and through the rotor. This keeps the surface material on cone C fairly even, thus maintaining a constant symmetry which helps eliminate potential vibration.

Figure 5:
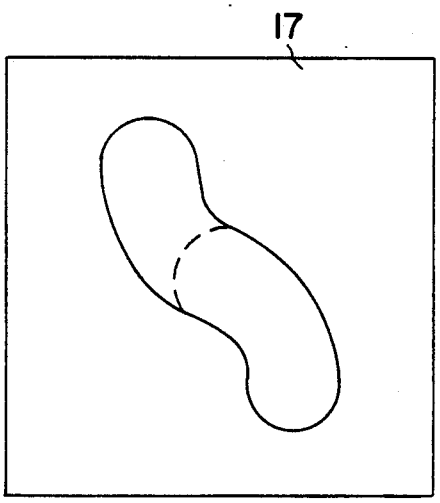
FIG. 5 is a top view of a feed plate of the quarry pulverizer of FIG. 1 with a wing type of opening.

Other pattern plates 17 may be used for different material M hardnesses as well as grading requirements. The pattern plate 17 of FIG. 5 shows a dual wing pattern, where as the dotted line indicates a single wing pattern. This type of pattern plate 17 allows for a relatively high volume feed rate and produces a higher proportion of fine material than larger pieces in the product.

Figure 6:
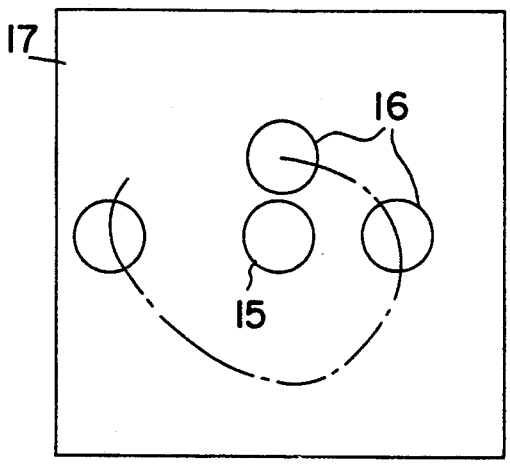
FIG. 6 is a top view of a feed plate of the quarry pulverizer of FIG. 1 with a central opening and openings extending radially outward.
Figure 7:
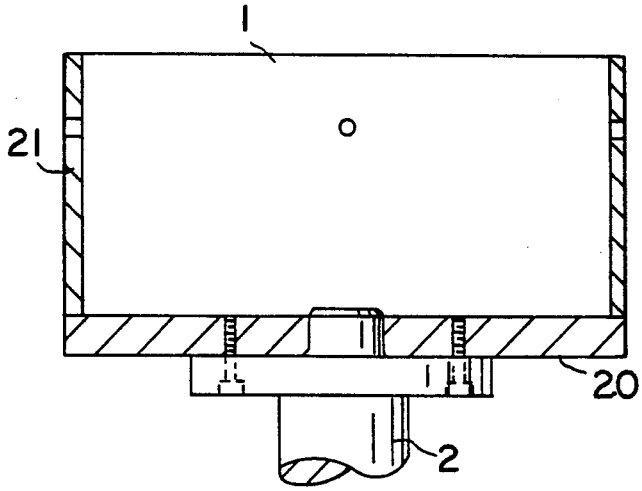
FIG. 7 is a front view of the rotor cup of the quarry pulverizer of FIG. 1.
Figure 8:
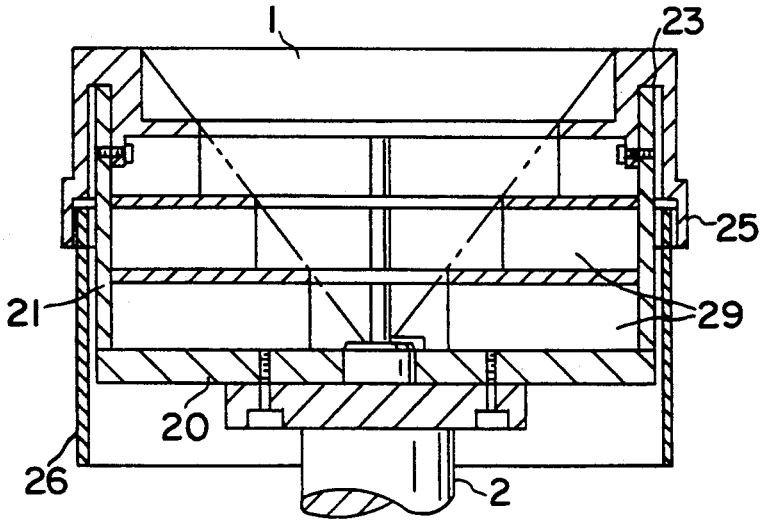
FIG. 8 is a front view of the rotor cup of the quarry pulverizer of FIG. 1 with cone defining rings, a plain wear ring, and a skirt that covers the top portion of a static protective shell.
Figure 9:
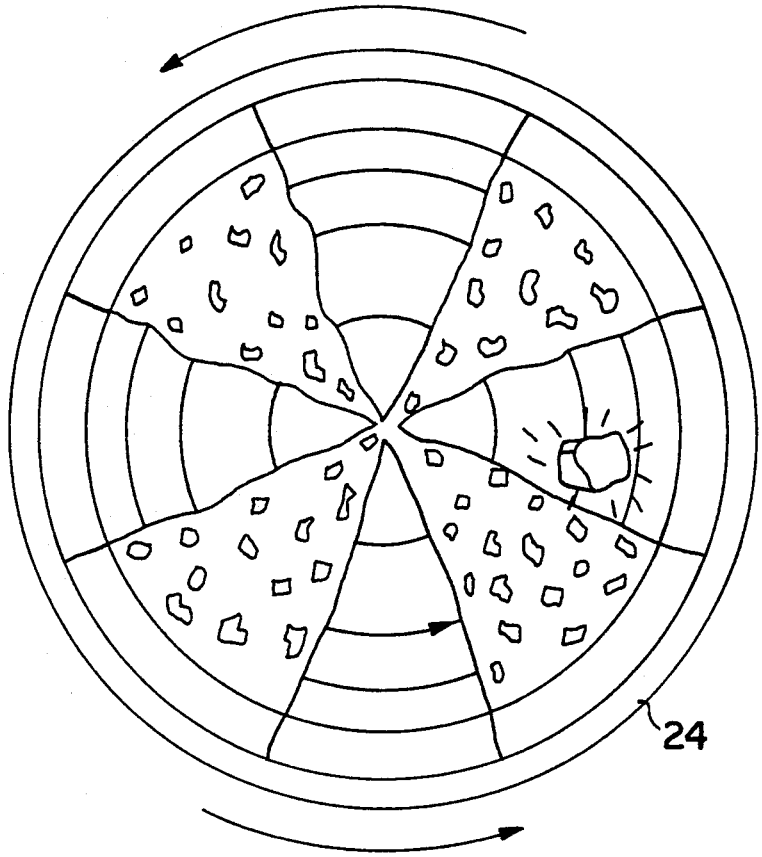
FIG. 9 is a top view of a castellated ring for the rotor of the quarry pulverizer of FIG. 1.
Figure 10:
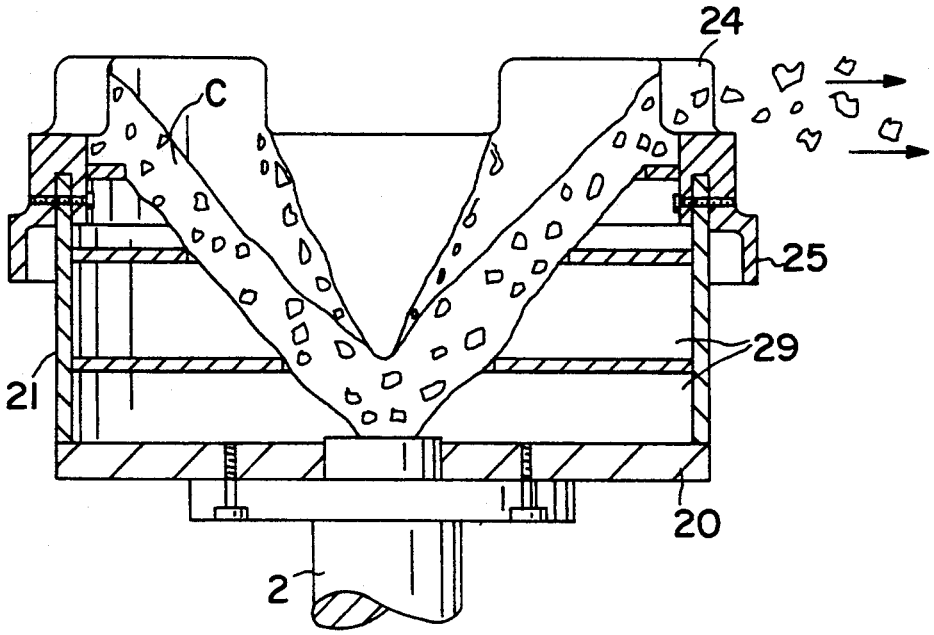
FIG. 10 is a front view of the castellated ring on the rotor of the quarry FIG. 1 engaged with cone defining rings and a static shell.
Figures 11, 12:
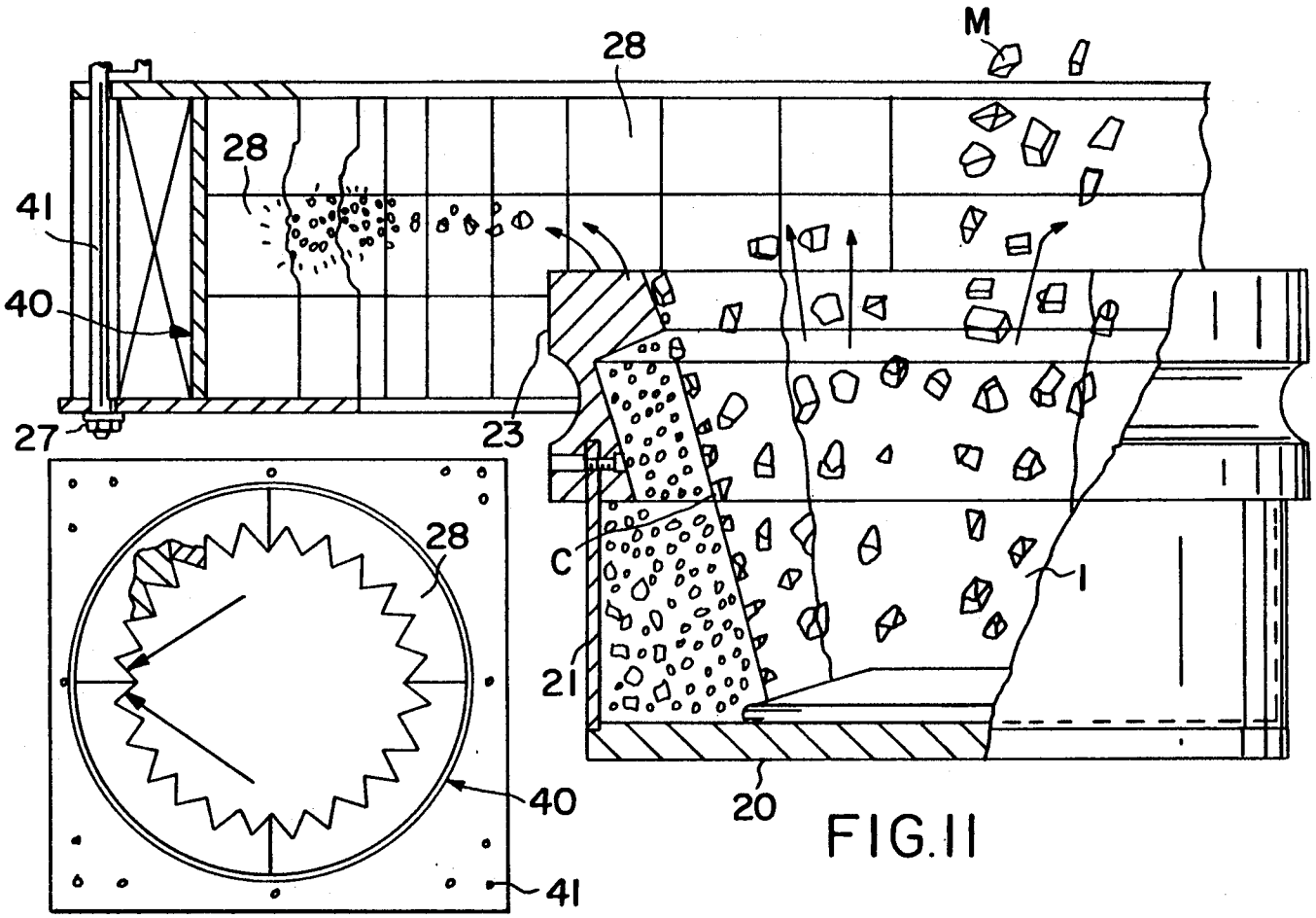
FIG. 11 is a section through the rotor cup and portion of the impact zone of the quarry pulverizer of FIG. 1 showing the modular impact block option.
FIG. 12 is a horizontal section of the impact block module of the quarry pulverizer of FIG. 1.

The pattern plate 17 of FIG. 6 shows a center feed opening 15 with off center feed openings 16 radially stepped away. This pattern plate 17 produces an increase in the amount of fine product over that of the construction of FIG. 5 and allows controlled feed rate. With any pattern plate 17, with off center openings 16, an early impacting action on the embedded cone of material C will occur.

The rotor cup 1 is the heart of the quarry pulverizer machine 4. In order that a perfectly formed cone of material C be built up within the rotor 1, a set of cone defining rings 29 are inserted into the rotor 1, whose outer diameters just fit into the cup of rotor cup 1, but their inside diameters step up in size from bottom ring to top ring such that a conical cavity is defined within the cup of rotor 1 (see FIG. 8). The rings are held in correctly spaced relation by spacer blocks 30.

Material M builds up one-half on of an inch over these rings 29 as it forms a conical bed C, and thus halts any further wear on the rings 29. The top of the rotor 1 is covered with a wear ring 23. It is this top wear ring 23 which will need to wear from top down to place the cone rings 29 into jeopardy. Both the top wear ring 23 and the cone rings 29 are relatively inexpensive and easily replaced.

The cup of the rotor 1 is comprised of the rotor shell 21 and the rotor base 20. Since replacement of these parts would be expensive as well as time consuming, the rotor 1 is completely protected from wear. Inside, the rotor 1 is protected by the inserted cone defining rings 29 and conical layer of material C. The top rim of the rotor 1 is covered with a plain wear ring 23 or a castellated ring 24. The wear ring 23 and castellated ring 24 have a skirt portion 25 which overlaps a static shell 26. The static shell 26 guards the outside of the rotor shell 21 from wear caused by ricocheting material.

Figure 14:
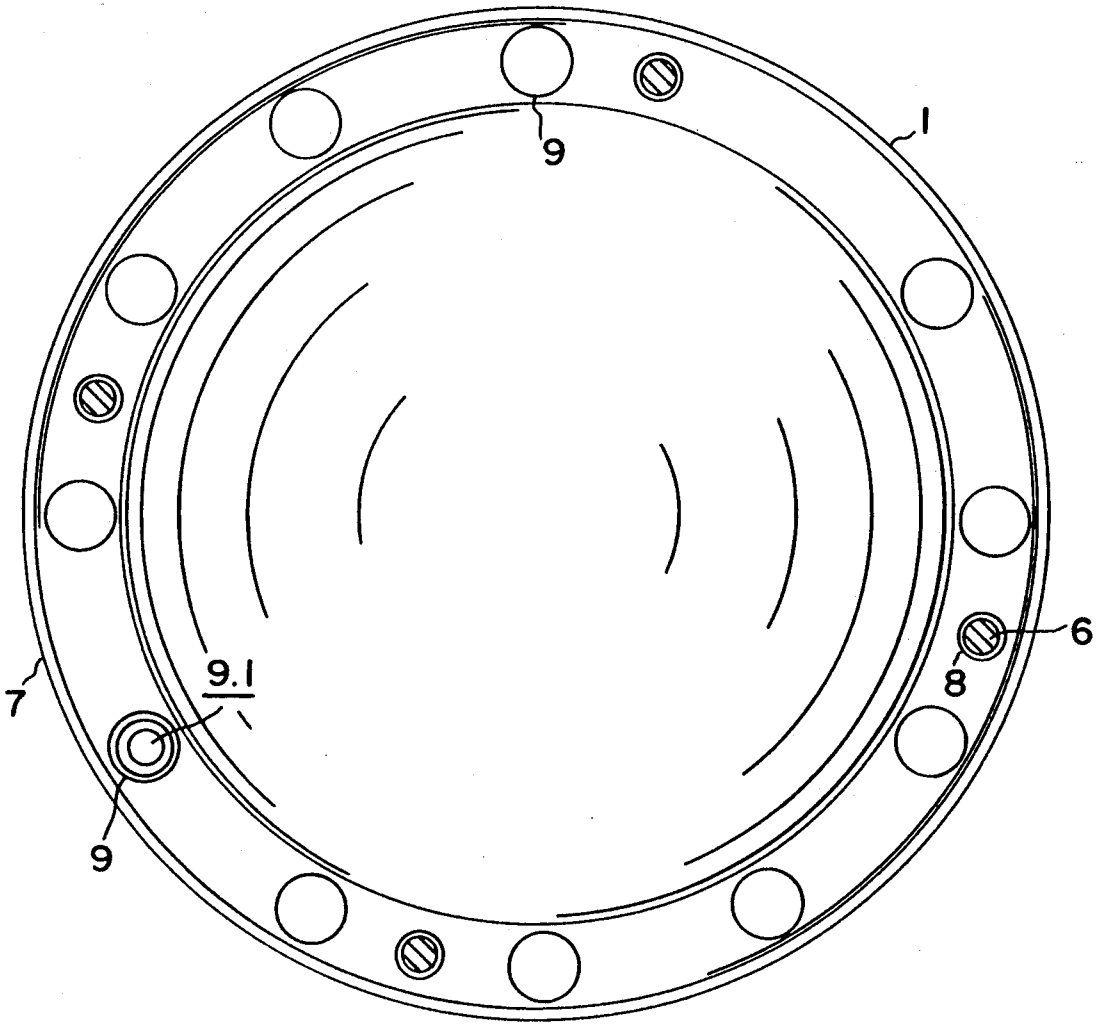
FIG. 14 is section view of the cradle along section line E—E of the quarry pulverizer of FIG. 16.
Figure 15:
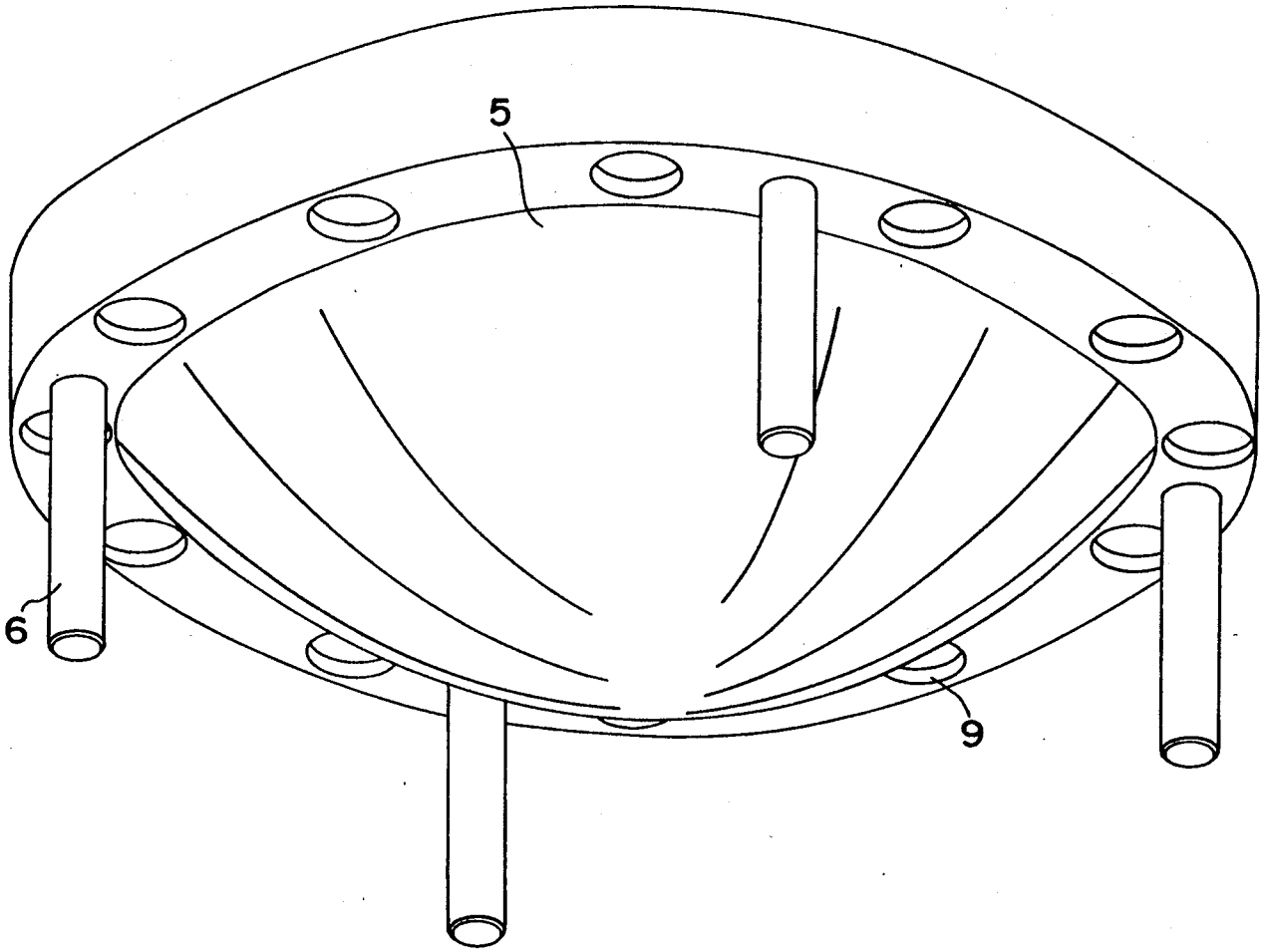
FIG. 15 is a perspective view of the rocker of the quarry pulverizer of FIG. 1.

The rotor 1 is connected to a motor 3 by a shaft 2. The motor 3 is mounted to a spherical convex rocker element 5 which rests in a concave cradle 7. Referring to FIGS. 14 and 15, the rocker 5 of FIG. 15 is a spherical section with projecting pins 6 around its outer perimeter which engage in pin holes 8 of cradle 7 shown in FIG. 14. This keeps the motor housing from turning as it spins the rotor 1. Also located around the outer perimeter of the cradle 7 is a plurality of spring pockets 9. Filling the pockets 9 with springs 9.1 helps this system maintain an essentially vertical and stable attitude at all times.

By the rocker 5 and cradle 7, with their spherical shape, allowing an unbalanced rotor to spin about new and different centers of gravity as they develop, due to changing weight distributions within the rotor 1, the threat of harmful vibration occurring is practically eliminated.

In summary, the rocker mechanism, the cone defining rings mounted within the rotor and the ability to provide a choice of pattern feeding options all work individually and collectively to absolutely eliminate the possibility of destructive vibration developing at any time.

Figure 13:
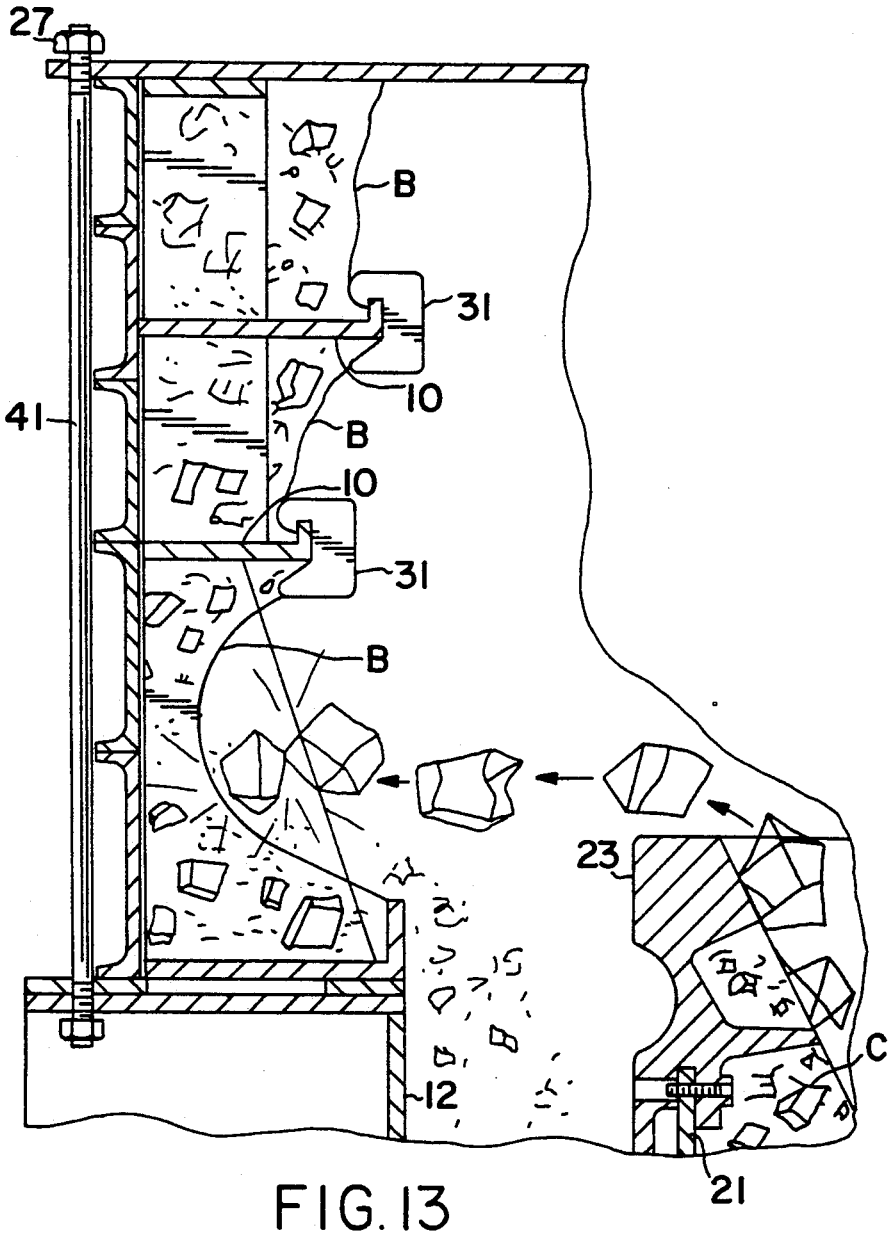
FIG. 13 is a section showing the banked up shelving impact module area of the quarry pulverizer of FIG. 1.

Once the material M leaves the cup of the rotor 1, it is thrust into the impact area. As depicted in FIGS. 1-3, the material M collides at modular shelf assembly 10. Subsequent impact and abrasion, as well as getting hit from behind, results in reduction of size as illustrated in FIG. 13. The walls and ledges of the impact modular 10 are protected from wear by the layer of banked up material B. The edges of the ledges of impact module 10 are guarded from ricocheting material by edge protectors 31.

Similar to the cup of the rotor, the impact area is of modular construction making it simple and easy to change back and forth between material on material impacting and material on metal impacting. Also maintenance and repair work is easier because the impact zone modular elements can simply be lifted in and out for easy access. Stand by ready to go modules can be used to quickly replace worn or damaged modules with a minimum of lost production time. The same applies if a change is required for meeting product coarse or fines specifications.

With the metal impact block module 40 the precast metal blocks need only to be laid in the circular container shell module frame without needing any special dovetail or bolted mounting devices.

Most material M is thrust at the middle level of impact blocks 28. When these blocks 28 wear, they can be readily interchanged with blocks 28 from less busy areas. Thus, even wear of all blocks together with superior impacting and reduction is achieved.

The material on material ledge module 10 usually produces more fine particles due to increased skidding abrasion than does the material on metal impact block module 28. Since the angle of impact between the material M and the blocks 28 is usually close to 90 degrees, skidding is minimized, and fewer fine particles in the finished product F result.

Using the material ledge module 10 produces more fine particles when, shaped as a polygon, its sides increase in number. This is due to a less direct impacting and more skidding. Thus, a circular material on material ledge module 10 produces the most amount of fine particles in the finished product F.

In FIG. 16, showing the dual rotor model, the static impact wall is replaced with a dynamic wall D in the form of an inverted rotor cup 51 mounted to a motor 53 by means of a hollow shaft 58. The upper rotor cup 51 spins counter rotational relative to the lower rotor 1. This is advantageous because the impact walls are constantly replenishing, a favorable angle of repose is maintained, and the opposing velocities add to the impact and subsequent reduction. Thus a higher degree of size reduction is accomplished and less recirculation of unreduced material results. This means higher efficiency of operation for the process.

Figure 18:
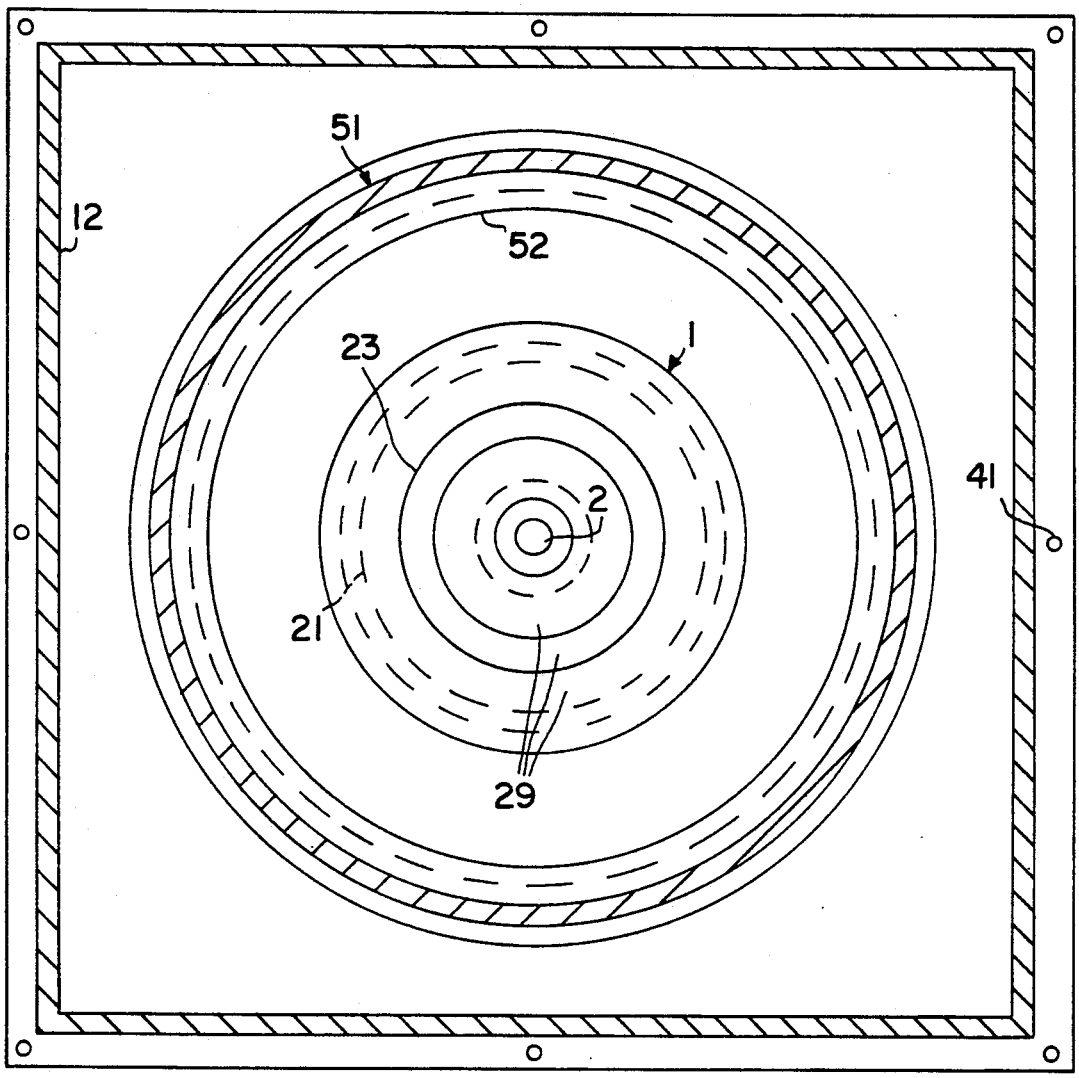
FIG. 18 is a section view along line C—C of FIG. 16 of the dual rotor model quarry pulverizer. The line is cutting through the shell of the upper rotor and looking down into the lower rotor cup assembly.
Figure 19:
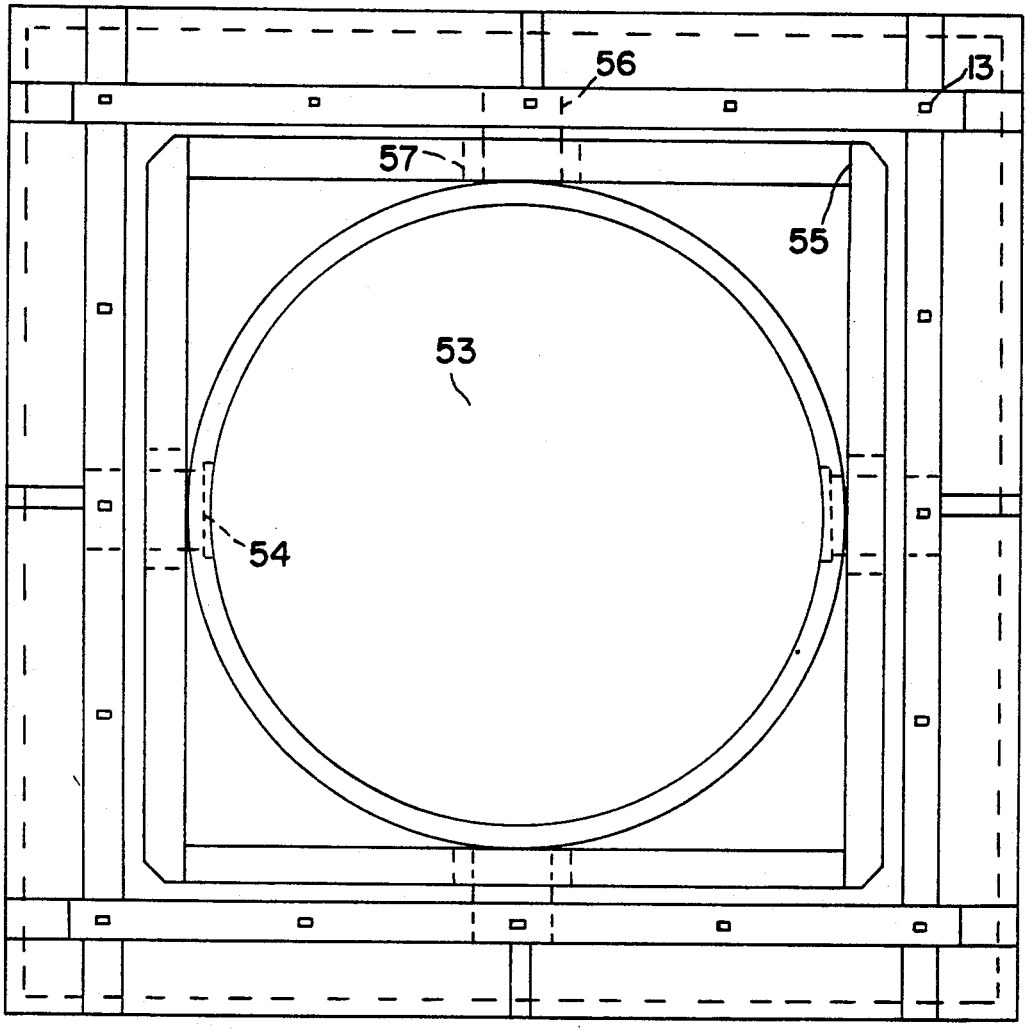
FIG. 19 is a section view along line D—D of FIG. 16 of the dual rotor model quarry pulverizer.

As seen in FIGS. 18 and 16, the upper rotor 51 is similar to the lower rotor 1. The upper rotor 51 has a protective wear ring 52 on its edge, is fitted with cone defining rings like the lower rotor 1, and is mass self centering by its trunnion means of support.

The housing of upper motor 53 does not turn as it spins the upper rotor 51 because it is restrained and supported by two projecting pins 54 which run through pin support openings 57 in the upper motor support yoke 55. Two other projecting pins 56 support the yoke 55. The pivot pin and support yoke arrangement for supporting the upper rotor permits axial realignment to compensate for various weight distributions on the same principal as previously described for the lower rotor, thus vibration problems are entirely eliminated here. Material M leaves the spinning upper rotor 51 by means of centrifugal discharge, impacts against the surface 50 of banked embedded material 49, then down chute 11 and is discharged into suitable collecting means.

A very important design concept of this invention is the modularity of construction. Most of the elements are readily interchanged with other elements with a minimum of mechanical disassembly involving tools because the components are so sized as to fit into standard size spaces without bolting and unbolting. The pulverizer can even be completely changed from a single rotor model as seen in FIG. 2 to a dual rotor as seen in FIG. 16. This is accomplished by removing the upper modular structure 14 as seen in FIG. 2 and replacing it with the upper rotor assembly 14.1 to make a dual rotor as seen in FIG. 16. Height adjustments to the upper modular structure that may be required as different models are formed is easily made by adding or subtracting layer structure elements 39 and using appropriate length tie bolts 41.

The following is a brief review of the basic novel concepts of this pulverizer invention just described:

A. Reduction of stone or ores by mainly impacting material on material, or under special circumstances, material on metal by accelerating the material up to high speed for attrition impacting with high r.p.m. cup style rotors.

B. Rotor vibration control means by:

a. Pattern control feeding of material to the cup rotor.

b. Cone defining rings in the rotor.

c. Rocker mounted rotor assemblies that allow shifting of the center of rotation to always be through the center of gravity.

Items a. and b. above keep the basic imbalances that occur within reasonable limits that allow the rocker mounted rotors to zero out any vibration producing factors.

C. Internal recirculating means for more efficient crushing.

D. Wear protection means by:

a. Banks of material covering rotors and direct impact zones where the crushing action takes place.

b. Shielding devices that are relatively inexpensive to protect critical areas that are not exposed to heavy crushing action but need protection from random ricochetting material.

E. Modular construction features that make for ease of maintenance and repair.

F. The ability to easily meet product grade specifications by the simple interchange of modular components and the use of variable speed motors to be able to run the rotors at different speeds.

G. The modular component mode of construction provides the flexibility to readily tailor the set up of the pulverizer to use materials of widely divergent characteristics found at different quarry sites.

The various mechanical means used that make this invention unique have herein been described with words and the use of drawings and recognizing that modifications and variations in the construction are possible without going beyond the scope of the following claims.

What is claimed is:

1. A centrifugal pulverizer for acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer, said rotor cup including a set of spaced apart rings inside its hollow portion such that the inside diameters of said spaced apart rings become progressively smaller at each level approaching the bottom of said rotor cup, thereby defining a conical cavity within said rotor cup to be covered with an even layer of said material under most conditions of operation.

2. A centrifugal pulverizer for acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer, said rotor means being mounted on universal acting support means, with resilient means being disposed radially around the axis of said universal acting support means, and said resilient means maintaining a balanced rotor means in vertical alignment and allowing an unbalanced rotor means to rotate about its center of gravity, thus eliminating destructive vibrations in the structure of the machine.

3. A centrifugal pulverizer for acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer, said rotor means being mounted on a semispherical rocker of a given radius resting in a semispherical cup like cradle of a slightly larger radius, resilient means being disposed radially around the axis of said rocker, said resilient means maintaining a balanced rotor means in vertical alignment and allowing an unbalanced rotor means to rotate about its center of gravity, thus eliminating destructive vibrations.

4. A centrifugal pulverizer for acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer, wherein said rotor cup has means to protect its rim from material bombardment and erosion by having a protective ring around its top circumference, and wherein the shell of said rotor cup is shielded from ricoheting bombardment with a frame supported static shell that wraps around said shell of said rotor cup with close running clearance and is overlapped by the apron skirt of said protective ring.

5. A centrifugal pulverizer acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer, wherein said rotor cup has means to protect its rim from material bombardment and erosion by having a protective ring around its top circumference.

6. A centrifugal pulverizer for acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer, wherein one kind of said impact component means can be process material banked up between impact material support shelf means that have their edges protected by renewable edge protectors around their complete inner periphery, wherein said impact material support shelf means are arranged in either a circular or polygonal fashion, depending on material grade requirements, and whereby all components of said impact component means are secured in place by sitting in a cavity formed by structural elements forming a portion of the outside walls of said pulverizer, all of which are held in place by appropriate fastening means properly spaced.

7. A centrifugal pulverizer acting as a reduction process machine for rocks or mineral bearing ores as recited in claim 6, wherein said impact material support shelf means may be readily replaced with a system of modular impact block components of hard material and of selected forms so as to produce different shapes and grades of product material, said modular impact block components requiring no individual mounting means, said modular impact block components being readily interchanged with others which have more or less wear so as to result in even wear on all of said impact block components as well as uniform reduction of said material, and whereby said system of modular impact block components may interchange with said impact material support shelf means through removal of said top cover means.

8. A centrifugal pulverizer for acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer, wherein feed stock of any reasonable size is pattern fed through interchangeable pattern plates to said rotor cup, wherein a selected pattern feed will produce a uniquely desired result, such as maintaining the symmetry of said rotor cup and helping eliminate vibration by having both outer radially fed material and center fed material cut ridges and fill gaps within the dynamic conical bed of material carried inside of said rotor cup, as well as processing rocks and ores of different hardness in certain ways so that a given particular product material demand specification can easily be met.

9. A centrifugal pulverizer for acting as a reduction process machine for rocks or mineral bearing ores, comprising, structure having a top cover means with a collecting hopper to accept material feed stock, a vertically mounted cup-shaped rotor means having a lower rotor cup with a rim for receiving said material feed stock from said top cover means, said rotor means centrifugally accelerating said material feed stock upwardly and outwardly over the rim of said lower rotor cup, impact component means surrounding the rim of said lower rotor cup against which centrifugally thrown feed stock material impacts, chute means where said material may gravity discharge, and means for rotating said lower rotor cup about the vertical axis of said centrifugal pulverizer, wherein said impact component means is a dynamic impact area in the form of an inverted rotating cup of banked material, wherein incoming feed material is fed into said lower rotor cup through a hollow shaft supporting said inverted rotating cup, wherein said inverted rotating cup spins in counter rotation relative to said lower rotor cup, wherein the opposing velocities of process material flowing from said lower rotor cup to said inverted rotating cup add to the efficiency of the reduction process of said material, wherein said inverted rotating cup is turned by motor means, wherein conical symmetry of the internal hollow cone of spinning material contained within said inverted rotating cup is maintained by cone defining rings placed therein, and whereby said inverted rotating cup is self balancing by means of a universal acting trunnion system which allows for axial realignment through the center of gravity of said inverted rotating cup when imbalancing factors occur, thus eliminating destructive machine vibration while producing an over all finer grade product.

10. A centrifugal pulverizer for acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer wherein a modular internal recirculating device made of hard material and placed concentric to said rotor cup and at an adjustable elevation blocks the path of high flying, low velocity material in order to rebound said high flying, low velocity material back into said rotor cup for further reduction prior to being ejected centrifugally at higher velocity against said impact component means surrounding said rotor means.

11. A centrifugal pulverizer acting as a reduction process machine for rocks or mineral bearing ores as recited in claim 10, wherein said modular internal recirculating deice is so placed as to allow low flying, high velocity, high energy, reduced material to eject from said rotor cup and impinge on said impact component means surrounding said rotor means for further reduction, and high flying, low velocity, larger material to first impact against said modular internal recirculating device and thereby become somewhat reduced in size, to then be bounced back into said rotor cup for further impact and abrasive reduction, and finally, to be ejected out of said rotor cup and into said impact component means that is receiving said low flying, high velocity, high energy, reduced material for further impact and abrasive reduction.

12. A centrifugal pulverizer for acting as a reduction process machine for rocks or mineral bearing ores, comprising, structure having a top cover means with a collecting hopper to accept material feed stock, a vertically mounted cup-shaped rotor means having a rotor cup with a rim for receiving said material feed stock from said top cover means, said rotor means centrifugally accelerating said material feed stock upwardly and outwardly over the rim of said rotor cup, impact component means surrounding the rim of said rotor cup against which centrifugally thrown feed stock material impacts, chute means where said material may gravity discharge, and means for rotating said rotor cup about the vertical axis of said centrifugal pulverizer, whereby the means for rotating said rotor cup about the vertical axis of said centrifugal pulverizer is a variable speed rotor drive system module, wherein said variable speed rotor drive system module may increase the speed of said rotor cup in order to produce a higher percentage of fines in the finished product and, conversely, whereby said variable speed rotor drive system module may decrease the speed of said rotor cup in order to produce less fines and more coarse material in the finished product, thereby making it easy to produce a finished product of required specifications.

13. A centrifugal pulverizer to act as a reduction process machine for rocks or mineral bearing ores as recited in claim 9, wherein the axis about which said lower rotor cup spins, the axis about which said inverted rotating cup spins, and the axis about which said motor means turns said inverted rotating cup are all coincident.

14. A centrifugal pulverizer acting as a reduction process machine for rocks or mineral bearing ores as recited in claim 6, wherein said protective ring may be replaced with alternative rim protective means, wherein said alternative rim protective means results in the formation of surface ridges and valleys in the working surface of said material layered in the hollow cone of said rotor cup, wherein said alternative rim protective means greatly increases material impact in the cone of said rotor cup with greater consequent reduction, and whereby said alternative rim protective means provides more positive traction with the inner surface of the hollow cone of said rotor cup to assure that maximum rim speed is achieved by each piece of said material as it leaves said rotor cup in the act of being hurled against said surrounding impact component means.

* * * * *